US009259072B2

(12) United States Patent
Friedman

(10) Patent No.: US 9,259,072 B2
(45) Date of Patent: Feb. 16, 2016

(54) FINGERNAIL POLISHING DEVICE AND METHOD OF ITS USE

(71) Applicant: Alexandra Paige Friedman, Laguna Hills, CA (US)

(72) Inventor: Alexandra Paige Friedman, Laguna Hills, CA (US)

( * ) Notice: Subject to any disclaimer, the term of this patent is extended or adjusted under 35 U.S.C. 154(b) by 0 days.

(21) Appl. No.: 13/862,583

(22) Filed: Apr. 15, 2013

(65) Prior Publication Data

US 2014/0305459 A1 Oct. 16, 2014

(51) Int. Cl.
*A45D 34/04* (2006.01)
*A45F 5/00* (2006.01)

(52) U.S. Cl.
CPC . *A45D 34/04* (2013.01); *A45F 5/00* (2013.01); *A45F 2005/008* (2013.01); *A45F 2200/05* (2013.01)

(58) Field of Classification Search
CPC ..... A44C 9/0061; A44C 9/0076; A45D 2029/008; A45D 29/00; A45D 29/11; A45F 2005/008; A45F 5/00; A61M 2209/082; A61M 5/008
USPC ..... 132/73; 206/1.7, 1.8, 129, 48, 7, 8; 220/914; 224/148.1, 148.7, 217; 248/444; D28/57, 61–62
See application file for complete search history.

(56) References Cited

U.S. PATENT DOCUMENTS 2,140,231 A * 12/1938 Jefferis ..... A45D 29/22 132/73
2,356,722 A * 8/1944 Harris ..... B43M 11/06 118/201
3,688,520 A * 9/1972 Strassel ..... A44C 9/0076 63/15
4,096,710 A * 6/1978 Sloan ..... A44C 15/009 63/15
4,646,953 A 3/1987 Marshall et al.
5,112,227 A * 5/1992 Bull ..... A61B 19/0256 206/63.5
5,567,070 A * 10/1996 Ficcadenti ..... A45D 40/265 132/73
5,732,862 A * 3/1998 Bull ..... F16M 13/04 206/63.5
5,881,734 A 3/1999 Trayes
5,913,312 A 6/1999 Donnell
D493,574 S 7/2004 Cheeks
7,703,302 B2 * 4/2010 Dussin ..... A44C 9/0076 63/15
2011/0108046 A1 * 5/2011 Horton ..... A45D 34/045 132/73

FOREIGN PATENT DOCUMENTS

AU 2011254057 A1 * 12/2011 ..... A44C 9/00
FR 2662917 * 12/1991 ..... A45D 29/11

* cited by examiner

*Primary Examiner* — Rachel Steitz
*Assistant Examiner* — Jennifer Gill
(74) *Attorney, Agent, or Firm* — Law Office of Ilya Libenzon

(57) ABSTRACT

A fingernail polishing device is disclosed. The device is a base portion on which a user can rest his or her hand, and a bottle holder portion that is fastened to the top of the base portion and securely holds a bottle of nail polish or nail polish remover while the user polishes the nails of the hand resting on the base portion. The base portion can curve upward and around to partially grip the user's fingers. The bottle holder may be an elastic flexible cup shaped to hold a bottle. The two parts can be detachable or integrated together.

6 Claims, 5 Drawing Sheets

FINGERNAIL POLISHING DEVICE AND METHOD OF ITS USE

TECHNICAL FIELD

This invention relates generally to fingernail grooming equipment, and more specifically to nail polishing stations and devices.

BACKGROUND ART

The act of nail polishing typically requires removing the worn residue of previous polishing sessions with a solvent such as acetone, followed by the careful application of one or more layers of nail polish on each nail using an applicator. The applicator, which may be a brush or sponge, is usually stowed inside a bottle of nail polish, with the bottle's cap doubling as a handle for the applicator. Nail polish bottles are generally small and light, and thus easily upset. This makes nail polishing a potentially messy business, requiring attention not only while painting the nails, but also while extracting the polish from the bottle: the bottle must generally be held in one hand (the one whose nails are being polished) while the applicator is dipped with the other hand. The bottle then has to be left open on some surface while the nails are polished, with great potential for spills. This limits the circumstances under which people can polish their nails: they must do so only where they have access to a flat surface, in an area where nobody is likely to upset the bottle by accident.

Some previous inventions have attempted to alleviate matters by providing means to grip the nail polish bottle during the polish application, keeping it under control of the polisher and making extraction of more polish easier. However, most of these approaches require the hand whose nails are to be polished to hold up the bottle or grip it in some way, which can be uncomfortable and puts unnecessary demands on the polisher's coordination. Others provide a mat or similar object that holds the bottle securely; these devices work well but are not portable enough to suit most peoples' needs.

Therefore, there remains a need for a portable, convenient, and comfortable nail polishing station.

SUMMARY OF THE EMBODIMENTS

It is therefore a goal of the present invention to provide a portable, comfortable, and convenient nail-polishing solution. It is a further object of this invention to prevent spills of nail polish and nail polish remover while nails are being polished. It is a still further object of this invention to allow a person who is polishing his or her nails to do so in the absence of a flat surface on which to place a bottle.

The instant invention is a nail-polishing device, made up of two portions: a base portion and a bottle-holder portion. The base portion has two support members that extend to the sides in such a way that a user can rest fingers on them. The bottle-holder portion is attached to the base portion, and is designed to hold a nail polish bottle securely while the user opens the bottle and uses it to polish his or her nails.

According to a related embodiment, there is a flat portion at the bottom of the base portion. Under an additional embodiment, the support members are curved on their upper surface to conform to the shape of human fingers. Another embodiment involves curving the support members upward to grip human fingers placed on them. The support members are substantially cylindrical under another embodiment, and the sidewalls of those substantially cylindrical support members are flattened according to another embodiment. According to a further embodiment still, the bottle-holder portion is fixed to the base portion at the juncture of the two lateral members. Under yet another embodiment, the bottle-holder portion is substantially cylindrical; the sidewalls of that cylindrical portion are flattened according to another embodiment. In another related embodiment still, the bottle-holder portion flares outward above where the fingers of a user would be placed. The bottle-holder portion includes an upright cup-shaped member that snugly fits a nail polish bottle inserted into it, under an additional embodiment. According to a further embodiment, that cup-shaped member is composed of a flexible elastic material such that some part of the cup-shaped member will stretch to accommodate variously-formed nail polish bottles and grip them securely. Yet another embodiment involves the bottle-holder portion being an integral part of the base portion, while one more embodiment enables the bottle-holder portion to be detached and reattached to the base portion.

Also disclosed is a method for using the above nail polishing device to polish fingernails. The method involves providing a nail polishing device made up of a base portion with two laterally extending support members upon which a user can rest fingers and a bottle-holder portion attached to the top of the base portion and adapted to receive and securely hold a nail polish bottle. Next a bottle is placed in the bottle holder, the fingers of one hand are placed on the support members, and the nails are treated using the contents of the nail polish bottle. A further embodiment of the method involves resting the nail polishing device on a surface while performing the above steps.

Other aspects, embodiments and features of the invention will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The preceding summary, as well as the following detailed description of the invention, will be better understood when read in conjunction with the attached drawings. For the purpose of illustrating the invention, presently preferred embodiments are shown in the drawings. It should be understood, however, that the invention is not limited to the precise arrangements and instrumentalities shown.

DETAILED DESCRIPTION OF SPECIFIC EMBODIMENTS

Definitions. As used in this description and the accompanying claims, the following terms shall have the meanings indicated, unless the context otherwise requires.

A "nail polish bottle" is a bottle of any product used in nail care, including without limitation nail paint, nail polish, nail polish remover, base coats, primers, top coats, hydration oils and creams, nail enamels, nail gels, and acrylic gel polish.

To "treat" nails using the contents of a nail polish bottle is to use the contents for their intended role in the nail decoration process. For instance, when the bottle contains nail polish remover, the user "treats" nails by removing nail polish, and when the bottle contains top coat, the user "treats" nails by applying a layer on top of previously-applied layers of nail polish.

Figure 1A:
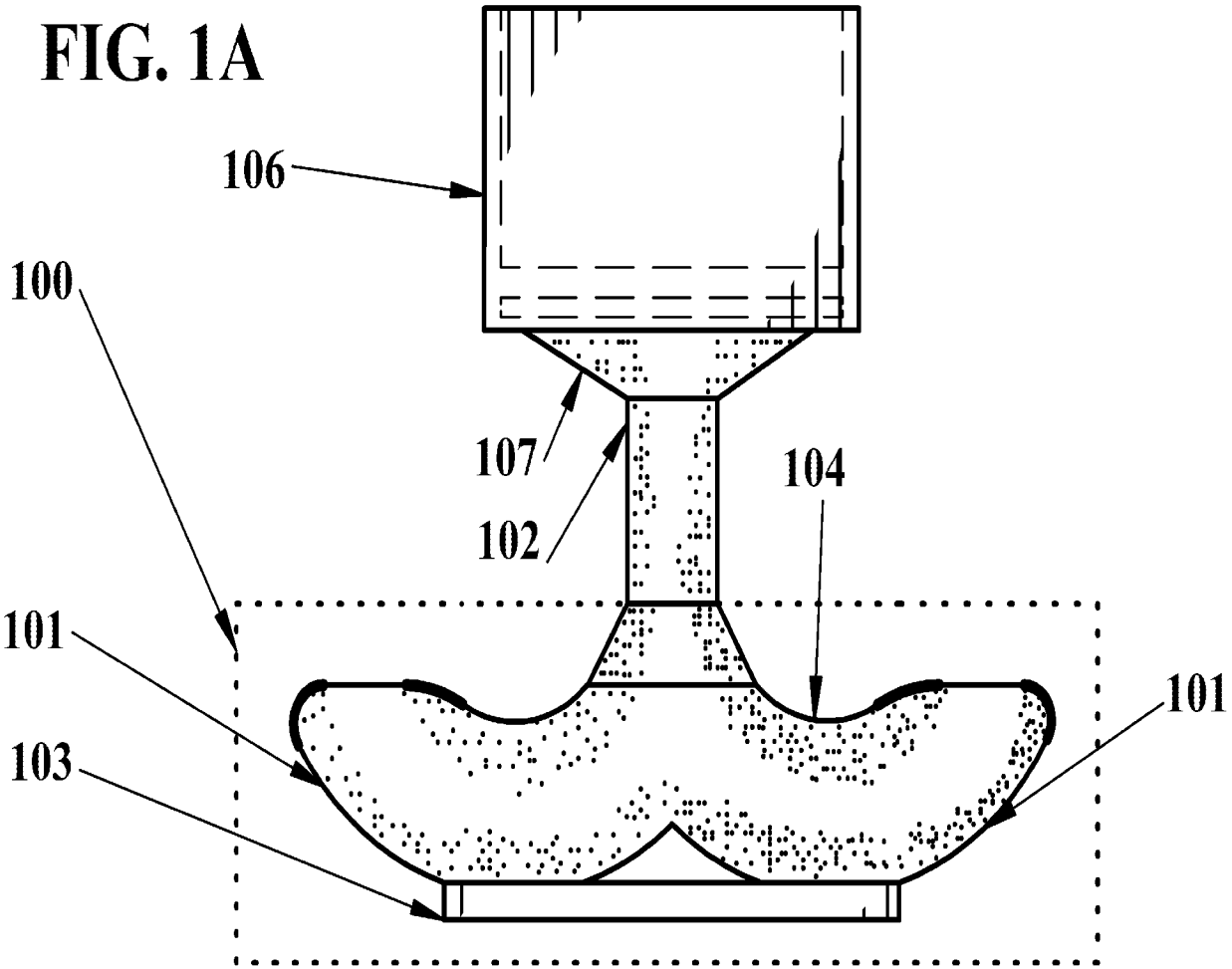
FIG. 1A is a schematic diagram illustrating a front view of one possible embodiment of the invention.

FIG. 1A illustrates some possible embodiments of the disclosed device. The essential elements of this invention are a base portion 100 and a bottle-holder portion 102. The bottle-holder portion 102 of the invention has two purposes: first, to provide a secure place to keep open bottles of nail polish and related products during the polishing process in the absence of a flat surface, and second, to hold those bottles in place while the top is removed or attached and the applicator is inserted and removed during the course of polishing. The ability to work without a flat surface frees the user to polish nails in almost any location. As noted above, the latter use of the bottle-holder 102 is helpful because nail polish bottles are generally small, and often light as well. Particularly where the nail polish is viscous, it is easy to upset or even lift the bottles by accident if one attempts to load the applicator with nail polish without holding the bottle somewhat firmly. The bottle-holder portion 102, by securely holding the nail polish bottles, thus enables a person to polish nails one-handed, without worrying about spills. There are a number of ways to secure the bottle to the bottle-holder 102, including a platform bearing a suction cup or reusable adhesive (such as a pressure-sensitive gel adhesive) that adheres to the base of the bottle, or a clamping device such as a collar that can be tightened by screwing or levering, or is spring-loaded to tighten on its own.

The base portion 100 accomplishes several purposes at once. First, it provides a finger rest, allowing the hand whose nails are polished to be kept motionless with little effort. This is accomplished by having the fingers of that hand rest on two lateral members 101 of the base, which spread out to create a surface on which the fingers can rest. The base portion also acts as the base for the bottle-holder portion 102, which is attached to it. The connection between the bottle-holder portion 102 and the base portion 100 should be firm, and sufficiently rigid to prevent the bottle from wobbling or tipping over. The point of connection should be placed in such a way as to permit the fingers of the hand whose nails are to be polished to rest on the lateral members 101 as intended. When the fingers of the hand to be polished are resting on the base portion 100, this confers the added benefit of weighting the base portion 100 to increase its stability. Most importantly, the use of the base portion 100, in combination with the bottle-holder portion 102, allows the user to polish nails equally well in the absence of a flat surface, by enabling the user to hold the bottle securely in the bottle-holder portion 102 and resting the base portion 100 on any available surface while polishing the nails.

Any materials that accomplish the above purposes can comprise the base portion 100 and bottle-holder portion 102. The device can be made of a single homogeneous material or a heterogeneous combination of different materials. Some portion of the materials making up the device must be strong and rigid enough to support the nail polish bottle securely. Materials that can accomplish this include without limitation metals, wood, plastics, resins, glass, ceramics, crystal and stone materials. If the device is composed of a heterogeneous combination of materials, some portions can be made of softer matter. For instance, the upper surface of the lateral members 101 that serves as a finger rest could be a soft rubber or textile material to cushion the fingers. As noted above, some parts of the bottle-holder portion 102 might be adhesive, hinged, flexible, or have elastic properties as necessary to secure the nail polish bottle according to the implementation of the invention.

Figure 1B:
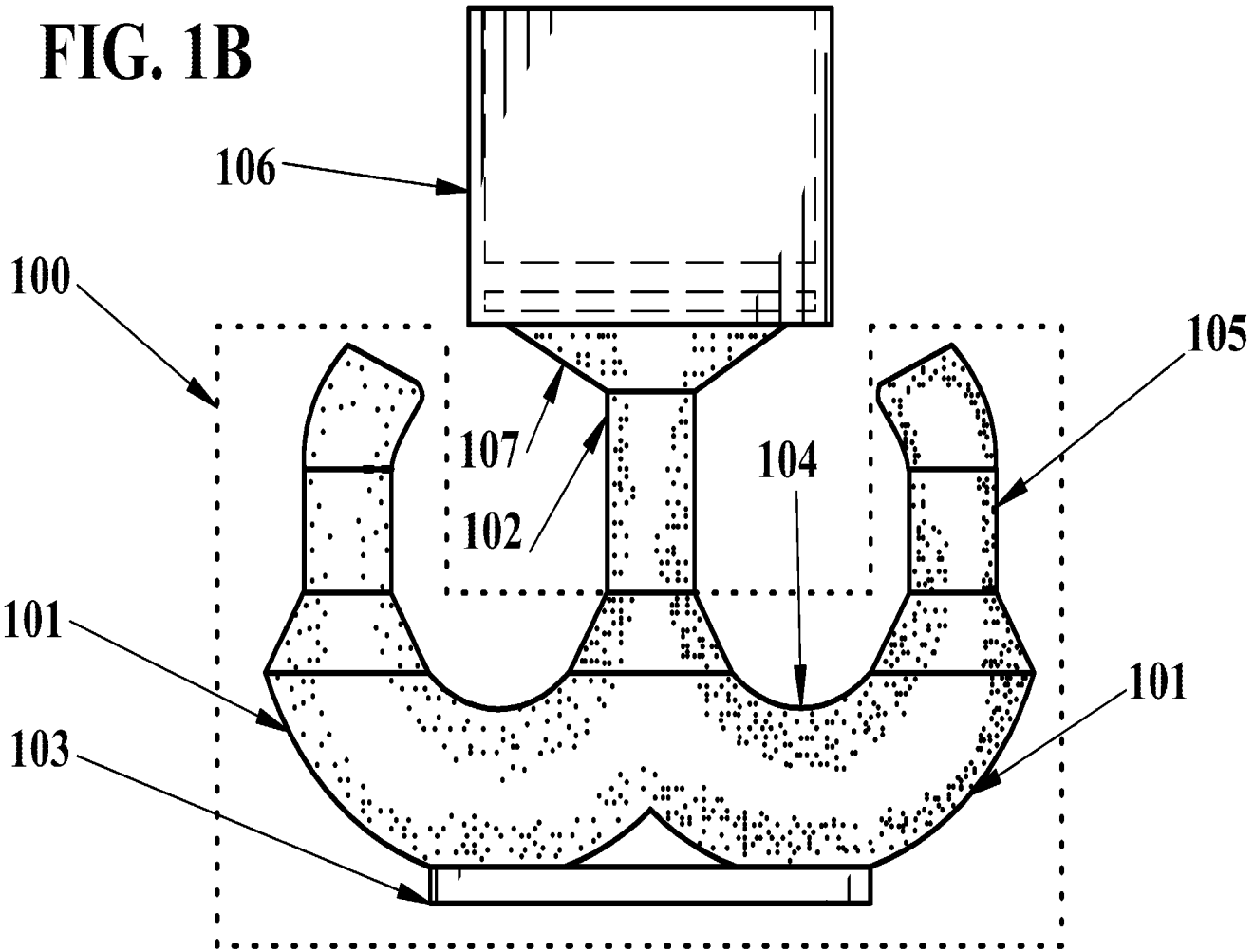
FIG. 1B is a schematic diagram illustrating a front view of another possible embodiment of the invention.
Figure 2:
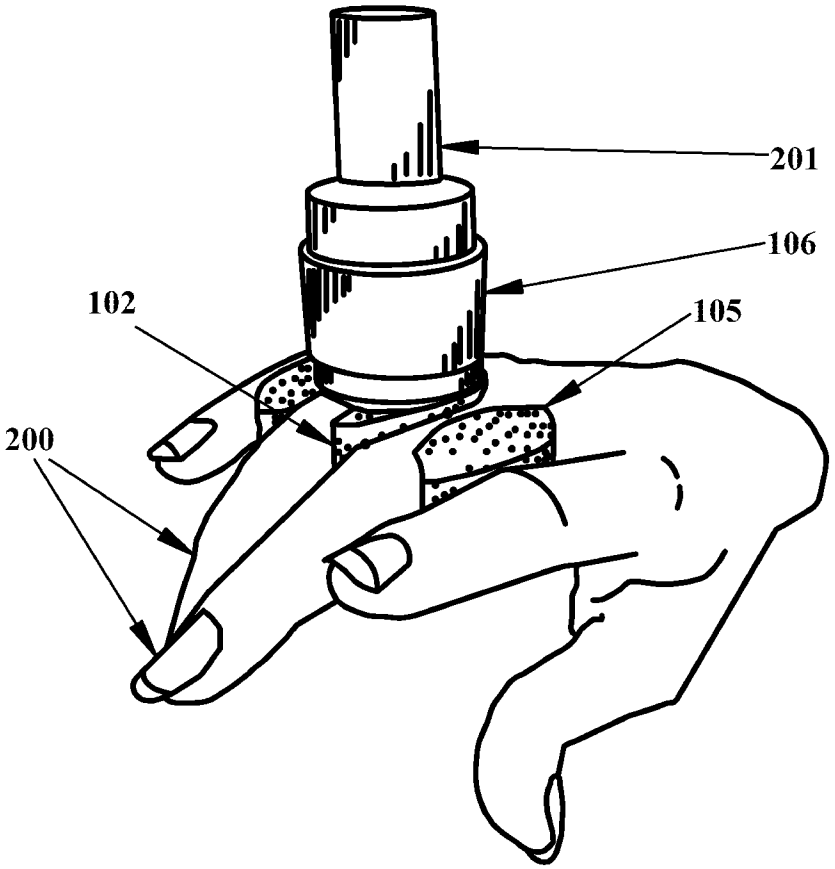
FIG. 2 shows a perspective view of the invention with a hand placed into it as intended and a bottle placed in the bottle-holder portion.
Figure 4:
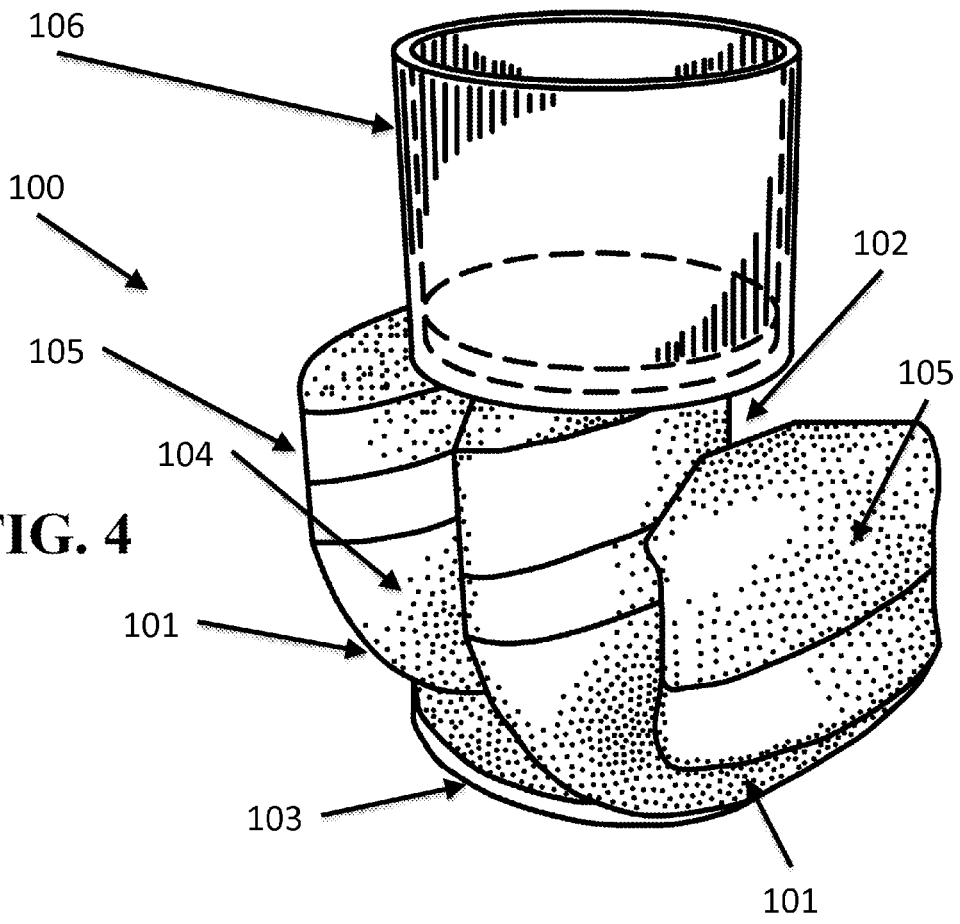
FIG. 4 shows a perspective view of the invention without a hand placed in it.

Some embodiments of the invention include additional adaptations to increase the device's comfort and ease of use. The base portion 100 can have a flattened area 103 on its bottom to aid in stability. This both helps secure the device against tipping and makes the process of polishing easier because it obviates the need to hold the base portion steady. According to other embodiments, the upper surface 104 of the lateral support members 101 is curved to accommodate the fingers resting on it more comfortably and securely. Another variation FIG. 1B employed by some embodiments is an upward curvature of the lateral members 105, which enables them partially to grip the fingers laid on the base portion 100. This can involve solely extending the curvature of the upper surface 104 of the lateral members 101 to form a U-shaped curve, or a further extension into a c-shaped curve as depicted in FIG. 1 to slightly enclose the fingers. The latter approach holds the fingers in place enough to encourage the user to keep their hand there and to make it easy to do so, without pinching or confining the fingers unduly. As shown in FIG. 2, the portions of the support members 105 that curve upward will better conform to the fingers 200 placed between them if they have the approximate form of a cylinder, and in particular of an ovoid cylinder. They will fit still more comfortably if the side-walls of that ovoid cylinder are flattened, as shown in FIG. 2. The flattened ovoid cylindrical shape of the support members 105 can be seen more clearly by reference to the perspective view in FIG. 4 and the front view in FIG. 1.

The secure and comfortable space for the fingers in the device can be accentuated by having the bottle-holder portion 102 connect to the base portion 100 at the juncture of the two lateral support members 101, effectively creating two channels for fingers, as shown in FIG. 1A and FIG. 1B. Attaching the bottle-holder portion 102 in the center of the base portion 100 in that way also helps to balance the device. As this configuration involves placing the bottle-holding portion 102 between the fingers, this configuration will be more comfortable if the bottle-holder portion is cylindrical, or a close approximation of a cylinder; where it passes between the fingers it should ideally form an ovoid cylinder, causing it to appear slim in its front view 102. If the sidewalls of the ovoid cylinder are flattened, it will be more comfortable still. FIG. 2 shows this embodiment of the device in perspective; so much of the bottle-holder portion 102 that fits between the fingers 200 of the user is substantially an ovoid cylinder with flattened sidewalls. The flattened ovoid cylindrical shape of that portion of the bottle holder 102 can be seen more clearly by reference to the perspective view in FIG. 4 and the front view in FIG. 1B. As a result, it fits comfortably between the fingers 200. The bottle-holder portion 102 can also help to hold the fingers in place in the device FIG. 1A by flaring outward 107 above where it passes between the fingers. When combined FIG. 1B with the curvature of the support members 105 as described above, this has the effect of producing a partially-enclosed tube in which the fingers can fit. In FIG. 2, it is possible to see how the curvature of the support members 105 combines with the outward flare of the upper bottle-holder portion 102 to enclose the fingers 200 of the user's hand. As the depiction shows, this would enable the user either to grip the device between his or her fingers and hold it suspended in the air, or to rest the device on a surface while treating the nails of the hand.

A particularly simple and effective way FIG. 1B to secure the bottle to the bottle-holder 102 is by forming the latter into a cup-shaped portion 106, into which the nail polish bottles may be inserted. Many nail polish bottles come in similar sizes and shapes, so the cup 106 may be formed to fit a common size and shape for a nail polish bottle snugly. A sufficiently snug fit between the bottle and the cup will achieve both goals of the bottle-holder portion 102: providing a place to put the bottle, and holding it securely while the fingernails are treated. The cup 106 can be formed into a cylinder, to accommodate a cylindrical bottle, but it need not be restricted to that shape; some implementations could form cups 106 with square, rectangular, ovoid, and other cross-sectional shapes. If the invention is sold with a particular nail polish brand, the cup 106 could be formed to fit the particular size and shape of bottle corresponding to that brand. FIG. 2 shows a cup 106 as described above, snugly fitted around a nail polish bottle 201 that is resting on the bottom of the cup 106.

One way FIG. 1A to make a more generally applicable cup portion 106 and to improve the cup portion's 106 grip on nail polish bottles is to form some part of the cup portion 106 using a flexible, elastic material. The elastic material can then be stretched to accommodate variously shaped and sized bottles, and can also conform to those bottles' contours. One way to accomplish this is to compose the cup's 106 vertical walls entirely of the flexible elastic material, but other approaches could be used, such as having the walls comprise rigid panels joined by elastic portions, or by having rigid cup 106 walls topped by a flexible, elastic collar. There are various materials with the elastic, flexible qualities required, including rubber, other latex products and synthetic variants thereof, as well as various plastic, metal, and textile materials.

Another choice to make in implementing this invention is how to connect the bottle-holder portion 102 to the base portion 100. One option is to manufacture the device as a single fused unit, in which the base portion 100 is integrally connected to the bottle-holder portion 102 so that they remain fused throughout the life of the product. This approach has the advantage of simplicity: there is only one part to keep track of, and the product can be made very easy to clean if it has a continuous outer surface with no visible joints. Alternatively, the base portion 100 and bottle holder portion 102 could be manufactured as separate parts, which can be attached and detached from each other. This option would make it possible for there to be multiple bottle holders 102, each designed for a different kind of bottle.

Figure 3:
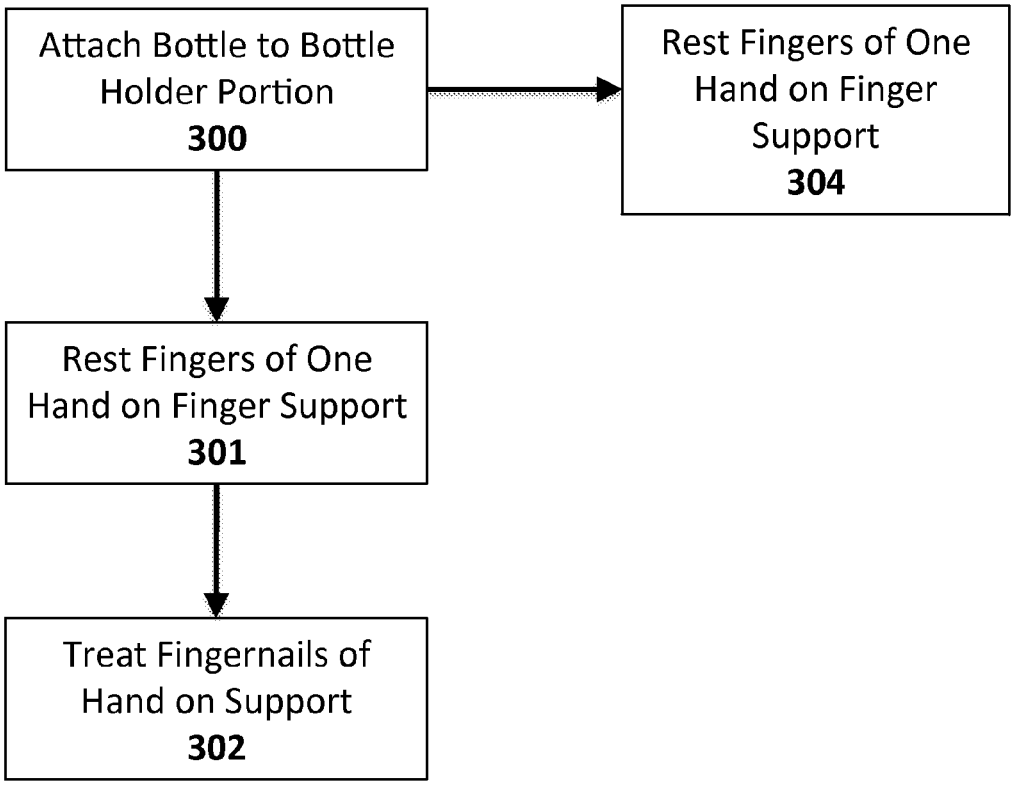
FIG. 3 is a flow chart describing embodiments of the claimed method.

The method for use of the nail polishing station is as follows FIG. 3: first, the desired nail polish bottle is attached to the bottle-holder portion of the device 300. In other words, the bottle-holder portion is caused to hold the nail polish bottle in the manner in which it was designed, in that particular implementation, to hold a nail polish bottle. Next, one hand is placed on or in the device so that the fingers are resting on the lateral support arms in the location and orientation for which the finger-rest portion of those arms is designed 301. Finally, the nail polish bottle is used to treat the fingernails of the hand that is resting on the finger rests 302. Thus, if the nail polish bottle contains nail polish remover, the treatment 301 of the nails involves removal of nail polish, whereas if the nail polish bottle contains nail polish, treatment 301 involves polishing or painting the nails. This method can be repeated many times throughout the course of a nail polishing session, using for example a nail polish remover, base coat, colored coats, and top coat in succession, each with its own bottle. Another step that can be added to the method is that of resting the nail polishing device on a flat surface 303, which as noted above makes the process easier, and the device more stable. FIG. 2 illustrates the moment after the fingers 200 have been placed on the lateral members 105, with the bottle 201 secured to the bottle-holder portion 102.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A nail-polishing device, comprising:

a base portion comprising two laterally extending support members, each laterally extending support member having a proximal end at a juncture with the other laterally extending support member, and each laterally extending support member having a distal end, the base portion having a bottom surface and a top surface upon which a user can rest fingers during use of the device, and each laterally extending support member having an upwardly projecting portion at the distal end of that laterally extending support member;

a bottle-holder portion having a lower end fixed to the top surface of said base portion at the juncture of the two laterally extending support members, and an upper end, the bottle-holder portion having a section that flares outwards from an initial height between the lower end and the upper end toward the upper end; and a cup-shaped member having a bottom fixed to the upper end of the bottle-holder portion and a top with an opening adapted to receive a nail polish bottle and wherein said cup-shaped member may be detached from and reattached to said bottle-holder portion;

wherein the bottom surface of the base further comprises a flat, planar area centered beneath the lower end of the bottle-holder portion, each upwardly-projecting portion extends at least as high as the initial height of the section of the bottle holder portion that flares outward, and each upwardly projecting portion has a top end that inclines inward toward the upper end of the bottle holder portion.

2. A device according to claim 1, wherein said support members are curved, towards the top surface of the base portion, to conform to the shape of human fingers.

3. A fingernail polishing device according to claim 1, wherein said section of said bottle-holder portion that flares outward is located at a point on the bottle-holder portion above where fingers of a user would be placed.

4. A device according to claim 1 wherein said cup-shaped member snugly fits a nail polish bottle inserted in said cup-shaped member.

5. A device according to claim 4 wherein some portion of said cup shaped member is composed of a flexible elastic material such that said part of said cup-shaped member will stretch to accommodate variously formed nail polish bottles and grip said bottles securely.

6. A device according to claim 1 wherein said bottle-holder portion is an integral part of said base portion.

* * * * *